US010519611B2

(12) United States Patent
Szekely

(10) Patent No.: US 10,519,611 B2
(45) **Date of Patent: *Dec. 31, 2019**

(54) BEARING PAD

(71) Applicant: ASTRA CAPITAL INCORPORATED, Mississauga (CA)

(72) Inventor: Kenneth Szekely, Mississauga (CA)

(73) Assignee: ASTRA CAPITAL INCORPORATED, Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/290,956

(22) Filed: Mar. 3, 2019

(65) Prior Publication Data

US 2019/0194879 A1 Jun. 27, 2019

Related U.S. Application Data

(63) Continuation of application No. 15/665,563, filed on Aug. 1, 2017, now Pat. No. 10,266,993.

(60) Provisional application No. 62/370,478, filed on Aug. 3, 2016.

(51) Int. Cl.

| | |
|---|---|
| ***E01C 5/20*** | (2006.01) |
| ***E01C 5/00*** | (2006.01) |
| ***E01C 5/10*** | (2006.01) |
| ***E01C 15/00*** | (2006.01) |

(52) U.S. Cl.

CPC ..... *E01C 5/20* (2013.01); *E01C 5/001* (2013.01); *E01C 5/006* (2013.01); *E01C 5/10* (2013.01); *E01C 15/00* (2013.01)

(58) Field of Classification Search

CPC . E01C 9/08; E01C 9/083; E01C 9/086; E01C 5/16; E01C 5/20; E01C 5/22; E01C 11/02; E01C 2201/12; E01C 5/001; E01C 5/006; E01C 5/10

See application file for complete search history.

(56) References Cited

U.S. PATENT DOCUMENTS

| | | | | |
|---|---|---|---|---|
| 3,676,971 A * | 7/1972 | Dombroski | E01C 5/001 | 404/2 |
| 4,835,924 A * | 6/1989 | Blacklin | E04D 11/005 | 52/263 |
| 4,996,804 A * | 3/1991 | Naka | E04F 15/02452 | 52/126.1 |
| 5,333,423 A * | 8/1994 | Propst | E04F 15/02476 | 248/188 |
| 5,685,666 A * | 11/1997 | Marshall | E01C 5/005 | 403/293 |
| 6,171,015 B1 * | 1/2001 | Barth | E01C 5/001 | 404/34 |

(Continued)

*Primary Examiner* — Abigail A Risic

(74) *Attorney, Agent, or Firm* — Hodgson Russ LLP

(57) ABSTRACT

A bearing pad for receiving and retaining the substantially vertically oriented structural members of a module for use in constructing a pathway and supporting the pathway module on a ground surface can include a main body member having a lower ground engaging surface and a first slot defined by a first cross support member engaging portion of the main body member. The first slot can be planar and disposed transversely to the lower ground engaging surface of the main body member. The vertically oriented structural member that can be received and retained in the first slot by the first cross support member engaging portion of the main body member.

18 Claims, 12 Drawing Sheets

(56) References Cited

U.S. PATENT DOCUMENTS 6,189,289 B1 * 2/2001 Quaglia ..... E04F 15/024 52/126.4
7,140,156 B1 * 11/2006 Lowe, Jr. ..... E04F 15/02183 52/263
7,303,800 B2 * 12/2007 Rogers ..... B32B 3/02 428/44
7,344,334 B2 * 3/2008 Thorkelson ..... E01C 5/18 404/28
8,011,148 B2 * 9/2011 Bertke ..... E04F 11/1812 52/263
8,807,865 B1 * 8/2014 Modrono ..... E01C 13/065 404/27
9,834,893 B2 * 12/2017 Lynch ..... E01C 5/001
9,951,528 B2 * 4/2018 Kugler ..... E04F 15/0247
10,072,383 B1 * 9/2018 Stiles ..... E01C 9/004
2002/0026757 A1 * 3/2002 Scissom ..... E04F 15/02452 52/220.2
2002/0056238 A1 * 5/2002 Leines ..... E01C 5/20 52/177
2005/0193663 A1 * 9/2005 Lombardo ..... E01C 5/005 52/279
2005/0241243 A1 * 11/2005 Wright ..... E01C 5/005 52/79.9
2007/0193145 A1 * 8/2007 Wheatley ..... B29C 65/562 52/263
2007/0269265 A1 * 11/2007 Thorkelson ..... E01C 5/18 404/34
2009/0031658 A1 * 2/2009 Moller, Jr. ..... E01C 5/20 52/403.1
2011/0179728 A1 * 7/2011 Cerny ..... E01C 5/001 52/177
2012/0034030 A1 * 2/2012 Smith ..... E01C 5/001 404/34
2012/0275859 A1 * 11/2012 Caroli ..... E01C 5/001 404/22
2013/0167458 A1 * 7/2013 Cerny ..... E04F 15/02038 52/177

* cited by examiner 110
112
111
140
118
WB
WB 110
112
111
TT
TS
WW
WW
HH
112

110
112
120
140
150RB
150R
150L
150LB
160L
170RA
170R
170
180R
160R
WG
160
180R
188
170R
170
170RB
130
X
X
130
170L
170LA
180L
188
162
160
180L
170L
170LB
172
160R
150R
150RA
WG
150L
160L
150LA
120

110
194
140
192
111
160
130
190
170
SECTION X-X
190
160
192
TB
112
194

SECTION Y-Y

BEARING PAD

CROSS-REFERENCE TO RELATED APPLICATIONS

This application is a continuation of U.S. application Ser. No. 15/665,563, filed Aug. 1, 2017, which claims priority to U.S. Provisional Application No. 62/370,478, filed on Aug. 3, 2016, the entire disclosures of which are incorporated herein by reference.

FIELD OF THE DISCLOSURE

The present disclosure relates to bearing pads and more particularly to bearing pads for receiving and retaining the substantially vertically oriented structural members of a module, such as a plastic module, for use in constructing a pathway and supporting the module on a ground surface.

BACKGROUND OF THE DISCLOSURE

Pathways such as pedestrian walkways and the like are often made from modules that typically from a plastic material or combination of plastic materials, one or more composite materials, a metal material, or any other suitable materials or combination of materials. Typically, such modules, which are also often referred to as panels, have a top deck with end walls and side walls depending from the top deck. Also, for added structural rigidity and strength, there is typically a plurality of general vertically oriented cross support members depending from the top deck.

Such modules can be found in in U.S. Pat. No. 9,353,487 entitled Securely Interconnectable Modules For Use In Constructing A Pathway For Traffic issued May 31, 2016 and various United States published patent applications including U.S. Published patent application Ser. No. 14/955,179 entitled Heatable Module For Use In Constructing A Pathway For Traffic, U.S. Published patent application Ser. No. 14/955,214 entitled Securely Interconnectable Modules For Use In Constructing A Pathway For Traffic, U.S. Published patent application Ser. No. 14/955,233 entitled Heatable Pathway System For Traffic, U.S. Published patent application Ser. No. 14/955,248 entitled Module For Use In Constructing A Pathway For Traffic, and U.S. Published patent application Ser. No. 14/955,266 entitled Securely Interconnectable Modules, with each of these patents and published patent applications having a common inventor with the present patent application.

In each of these patents and published patent applications, the module that is used in constructing a pathway for traffic comprise a base member having a top deck with side walls and end walls depending from the top deck. A plurality of substantially vertically oriented structural members, referred to as cross support members, also depend from the top plate between the sidewalls and end walls. It has been found that if such a module rests on and is therefore supported by a gravel surface or possibly a dirt surface, it is possible for the various side walls and end walls and cross support members to dig into the gravel surface or dirt surface, which can cause at least two problems. First, the module may be unevenly supported and therefore may move, which is unacceptable. Secondly, the downwardly directed vertical forces transmitted from the relatively thin side walls, end walls and cross support members are transmitted to a correspondingly very small cross-sectional area of the ground surface, which can cause shifting of the ground surface.

In general principle, in order ameliorate these problems, the downwardly directed vertical forces from the side walls, end walls and cross support members need to be distributed more evenly over the ground surface.

The closest known prior art, which is considered to be not overly relevant, is U.S. Pat. No. 7,736,088 issued Jun. 15, 2010, to Boxall et al, discloses a Rectangular Bearing pad. The generally rectangular bearing pad is for transferring loads between a first cast-in-place slab and a second cast-in-place slab separated by a joint. The bearing pad is adapted to transfer load between the first and second slabs directed essentially perpendicular to the intended upper surface of the first slab, and allows relative movement between adjacent concrete slabs along the joint between the slabs with minimal joint opening between the slabs. A pocket former embedded within the first slab may also be included to position the bearing pad and create void space on the sides of the bearing pad to permit the relative movement. A compressible material along the side of the bearing pad may also be used to permit the relative movement. Neither the void space created by the pocket former nor the compressible material are dependent upon the existence of a significant gap in the joint between the concrete slabs.

It is an object of the present disclosure to provide a bearing pad for receiving and retaining the substantially vertically oriented structural members of a module for use in constructing a pathway and supporting the module on a ground surface.

It is an object of the present disclosure to provide a bearing pad for receiving and retaining the substantially vertically oriented structural members of a module for use in constructing a pathway and supporting the module on a ground surface, wherein the bearing pad is cost effective.

It is an object of the present disclosure to provide a bearing pad for receiving and retaining the substantially vertically oriented structural members of a module for use in constructing a pathway and supporting the module on a ground surface, wherein the bearing pad is inexpensive to manufacture.

It is an object of the present disclosure to provide a bearing pad for receiving and retaining the substantially vertically oriented structural members of a module for use in constructing a pathway and supporting the module on a ground surface, wherein the bearing pad can be made from a plastic material.

It is an object of the present disclosure to provide a bearing pad for receiving and retaining the substantially vertically oriented structural members of a module for use in constructing a pathway and supporting the module on a ground surface, wherein the bearing pad can readily be engaged with the module.

It is an object of the present disclosure to provide a bearing pad for receiving and retaining the substantially vertically oriented structural members of a module for use in constructing a pathway and supporting the module on a ground surface, wherein the bearing pad can slidably receive and retain the substantially vertically oriented structural members of the module.

It is a further object of the present disclosure to provide a bearing pad for receiving and retaining the substantially vertically oriented structural members of a module for use in constructing a pathway and supporting the module on a ground surface, wherein the bearing pad can effectively transmit the downwardly directed forces from the module to the ground below.

It is a further object of the present disclosure to provide a bearing pad for receiving and retaining the substantially vertically oriented structural members of a module for use in constructing a pathway and supporting the module on a ground surface, wherein the bearing pad can effectively transmit the downwardly directed forces from the module to a gravel surface below.

BRIEF SUMMARY OF THE DISCLOSURE

In accordance with one aspect of the present disclosure there is disclosed a novel bearing pad for receiving and retaining the substantially vertically oriented structural members of a module for use in constructing a pathway and supporting the module on a ground surface. The bearing pad comprises a main body member having a lower ground engaging surface and a first slot defined by a first substantially vertically oriented structural member engaging portion of the main body member. The first slot is generally planar and is disposed generally transversely to the lower ground engaging surface of the main body member. The first slot has a fully open top, a fully open first end and a fully open second end to thereby slidably receive a substantially vertically oriented structural member therein that is larger than the first upwardly open slot. In use, the substantially vertically oriented structural member that is slidably received and retained in the first slot is retained in place by the first cross support member engaging portion of the main body member.

In accordance with another aspect of the present disclosure there is disclosed a novel shim for use under a bearing pad. The shim comprises a base portion having a perimeter edge and a central portion. A first hook member and a second hook member each extending upwardly from the base portion. The first hook member and the second hook member are disposed in opposed relation on the base portion with the central portion disposed therebetween.

In accordance with another aspect of the present disclosure there is disclosed a novel apparatus for receiving and retaining the substantially vertically oriented structural members of a module for use in constructing a pathway and supporting the module on a ground surface. The apparatus comprises a bearing pad having a lower ground engaging surface and a first upwardly open slot, and a shim securable to the bearing pad in underlying relation thereto. In use, a substantially vertically oriented structural member of the module that is slidably received and retained in the first slot is securely retained in place by the bearing pad, and the bearing pad is slidably received and retained in load bearing relation by the shim.

Other advantages, features and characteristics of the present disclosure, as well as methods of operation and functions of the related elements of the structure, and the combination of parts and economies of manufacture, will become more apparent upon consideration of the following detailed description and the appended claims with reference to the accompanying drawings, the latter of which is briefly described herein below.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION

Figure 1:
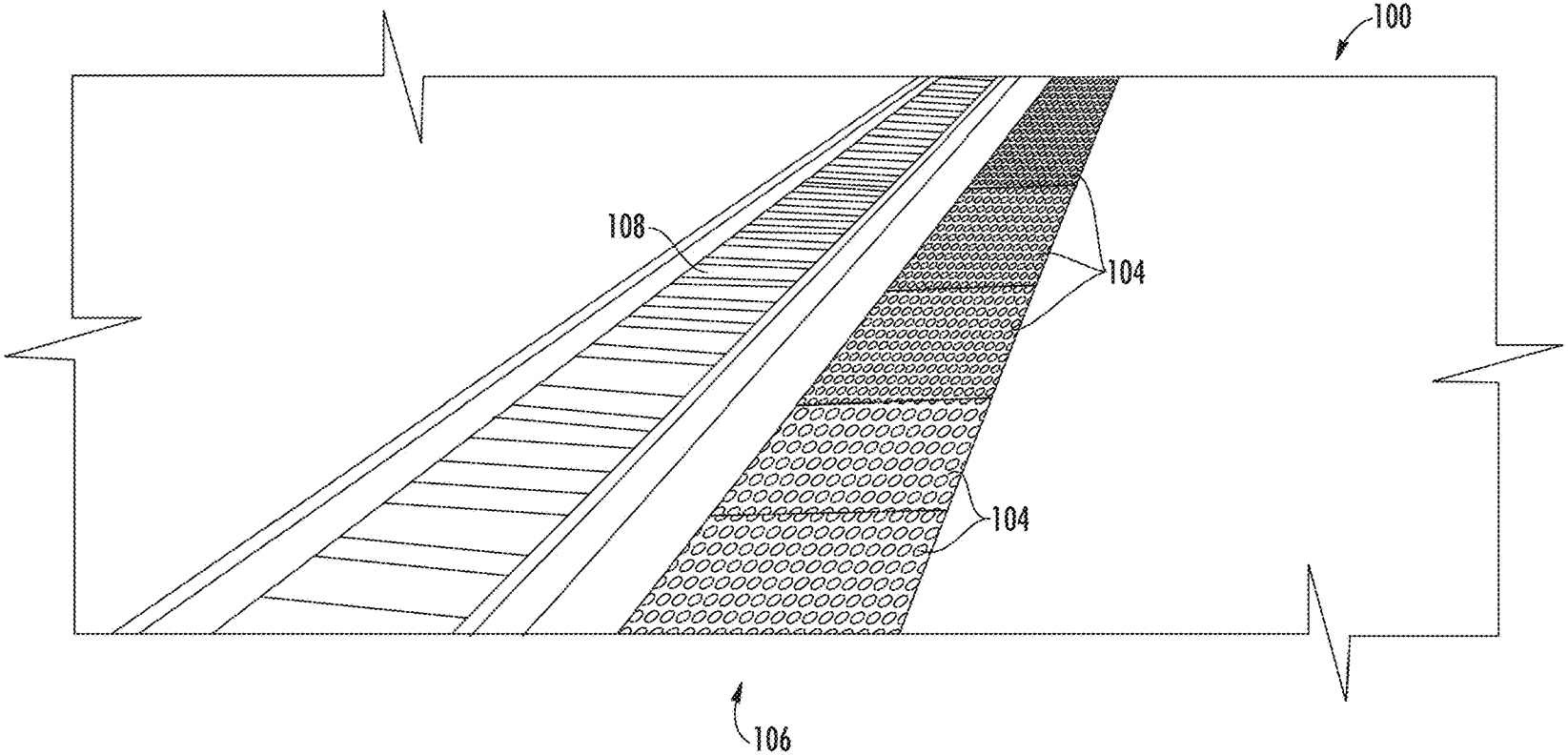
FIG. 1 is a perspective view from above of a plurality of pathway modules installed in place to form a pathway for traffic, specifically a transit platform, with the pathway modules each received and retained in weight bearing relation by the illustrated embodiment of the bearing pad according to the present disclosure.
Figure 2:
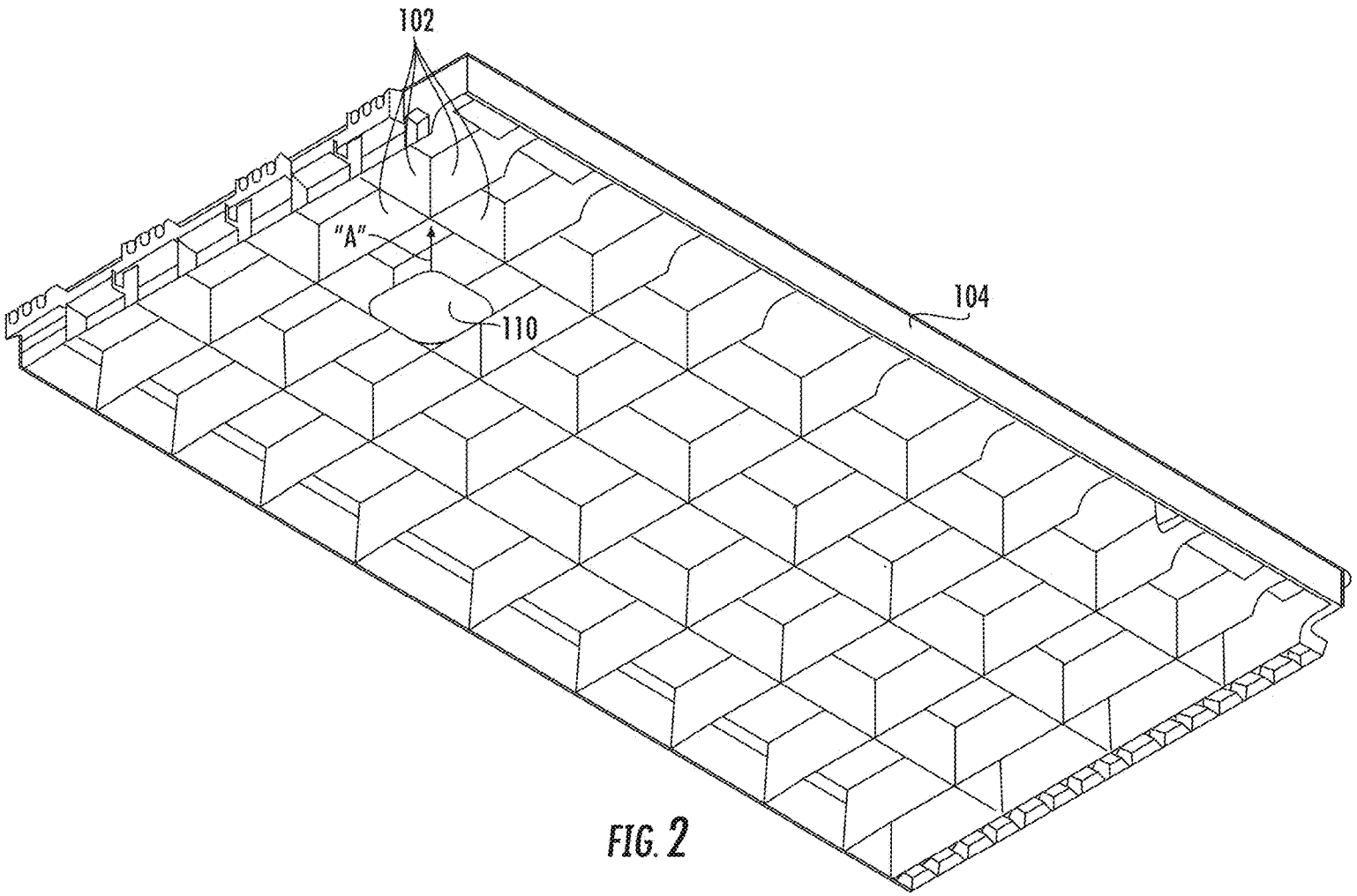
FIG. 2 is a perspective view from below of the illustrated embodiment of a pathway module as shown in FIG. 1, with one bearing pad of FIG. 1 shown being put in place on two of the transverse cross support members of the pathway module.
Figure 3:
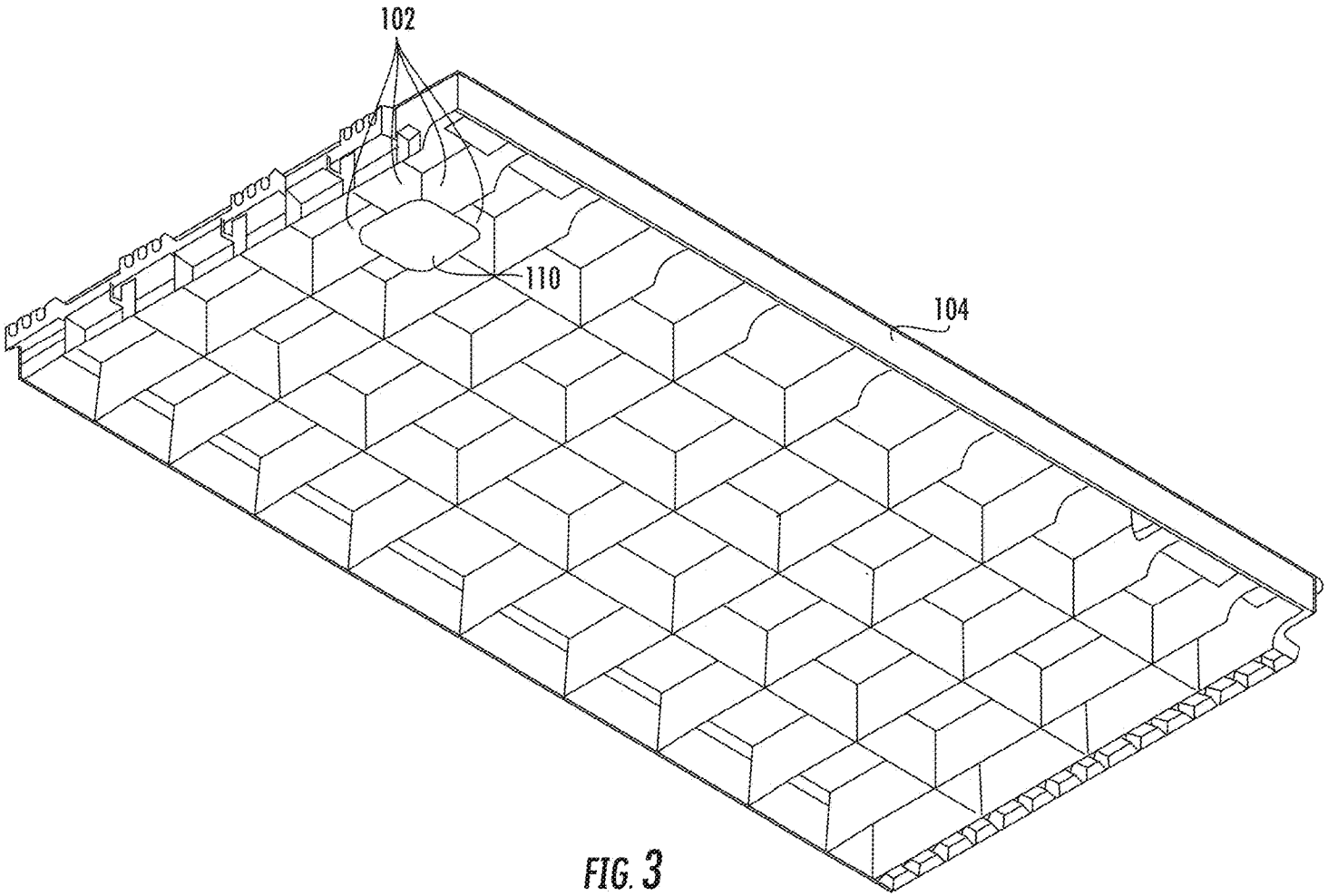
FIG. 3 is a perspective view from below similar to FIG. 2, but with the bearing pad having been securely retained in place on two of the transverse cross support members of the pathway module.
Figure 14:
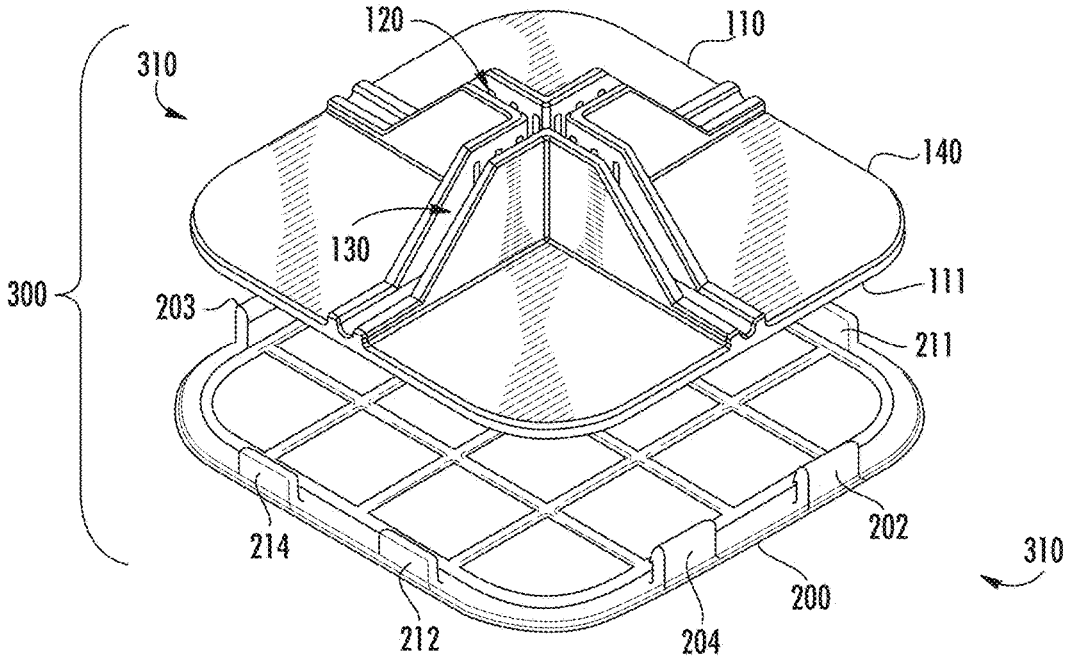
FIG. 14 is a perspective view from above of the first illustrated embodiment of the shim and the bearing pad according to the present disclosure, with the bearing pad being received and retained in load bearing relation by the shim.
Figure 15:
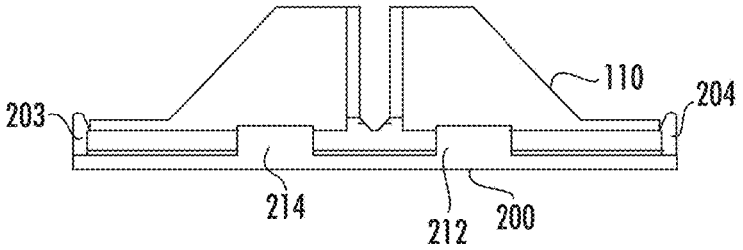
FIG. 15 is a front elevational view of the first illustrated embodiment of the shim and the bearing pad of FIG. 14.
Figure 16:
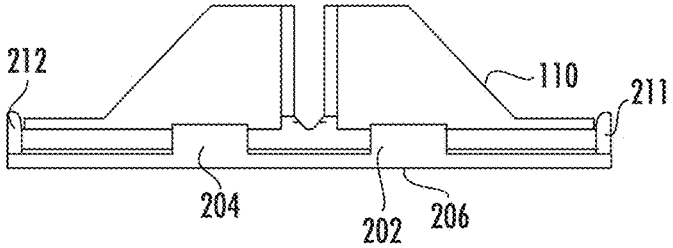
FIG. 16 is a cross-sectional side elevational view of the first illustrated embodiment of the shim and the bearing pad of FIG. 14.
Figure 17:
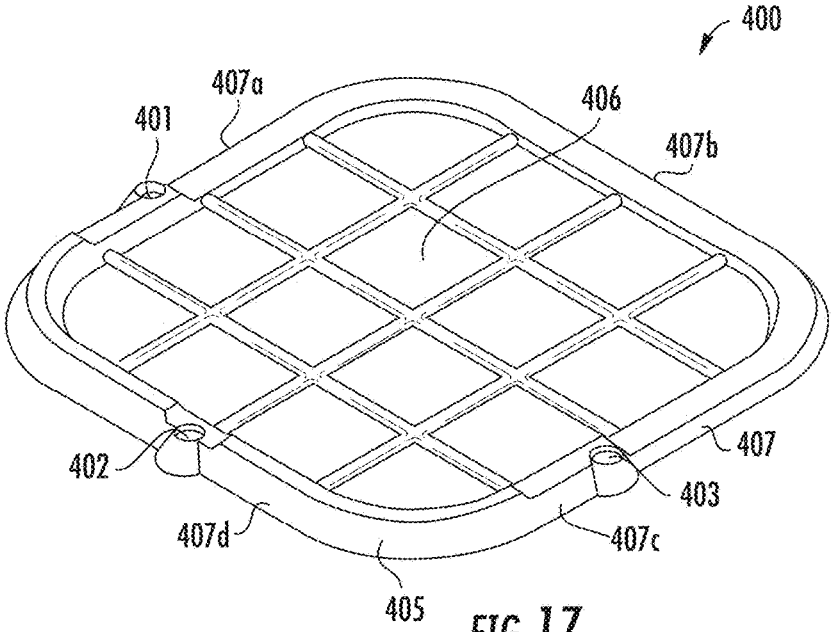
FIG. 17 is a perspective view from above of the second illustrated embodiment of the shim for use under the bearing pad according to the present disclosure.
Figure 18:
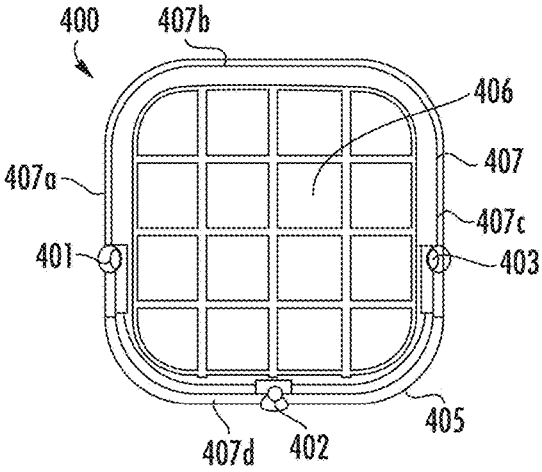
FIG. 18 is a top plan view of the second illustrated embodiment of the shim of FIG. 17.
Figure 19:
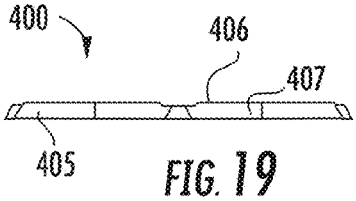
FIG. 19 is a front elevational view of the second illustrated embodiment of the shim of FIG. 17.
Figure 20:
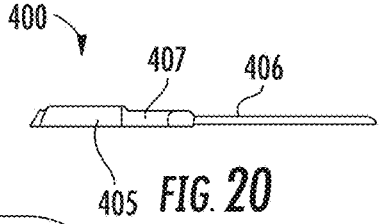
FIG. 20 is a side elevational view of the second illustrated embodiment of the shim of FIG. 17.
Figure 21:
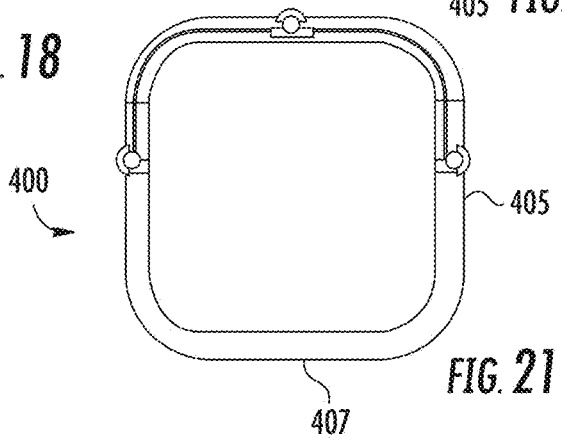
FIG. 21 is a bottom plan view of the second illustrated embodiment of the shim of FIG. 17.
Figure 22:
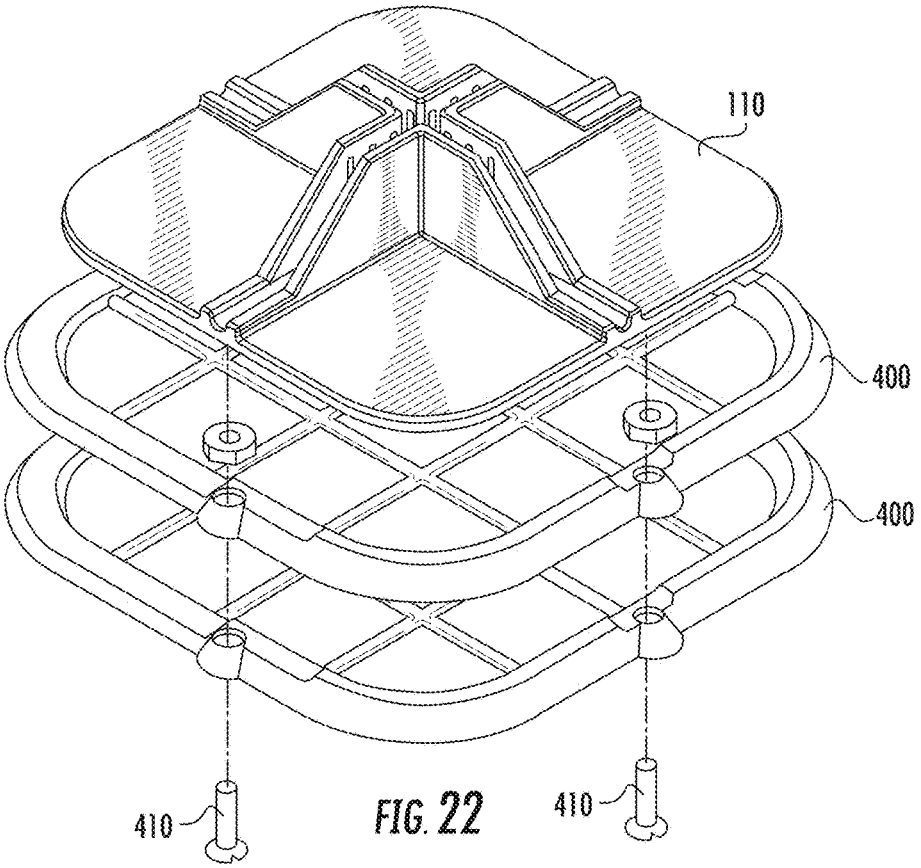
FIG. 22 is a perspective view from above of two of the second illustrated embodiment of the shims and the bearing pad according to the present disclosure, with the bearing pad about to be received and retained in load bearing relation by the shims.
Figure 23:
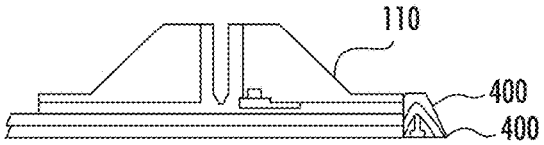
FIG. 23 is a front elevational view of the two second illustrated embodiment shims and the bearing pad of FIG. 22 secured together by threaded fasteners such that the bearing pad is received and retained in load bearing relation by the shims.
Figure 24:
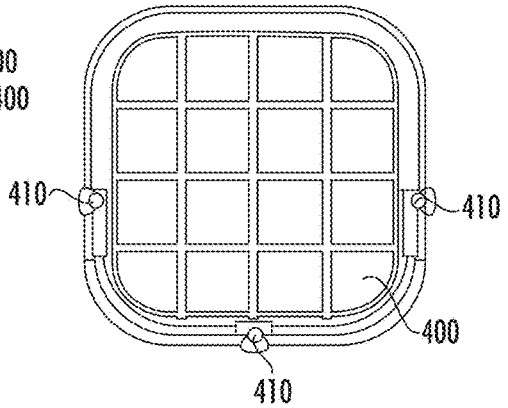
FIG. 24 is a top plan view of the two second illustrated embodiment shims and the bearing pad of FIG. 22.
Figure 25:
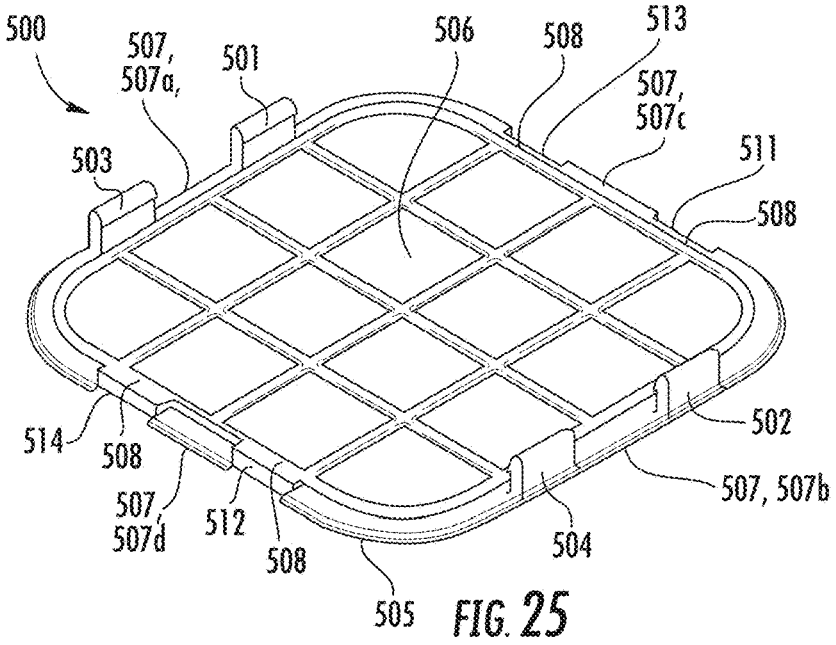
FIG. 25 is a perspective view from above of the third illustrated embodiment of the shim for use under the bearing pad according to the present disclosure.
Figure 26:
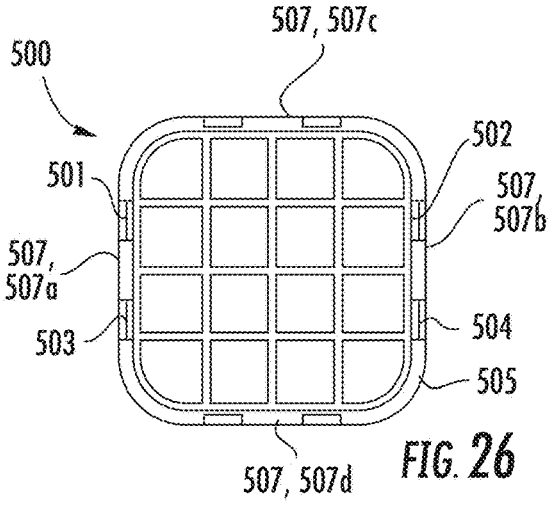
FIG. 26 is a top plan view of the third illustrated embodiment of the shim of FIG. 25.
Figure 27:
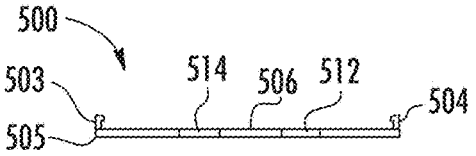
FIG. 27 is a front elevational view of the third illustrated embodiment of the shim of FIG. 25.
Figure 28:
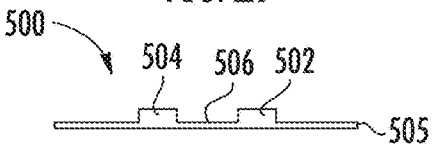
FIG. 28 is a side elevational view of the third illustrated embodiment of the shim of FIG. 25.
Figure 29:
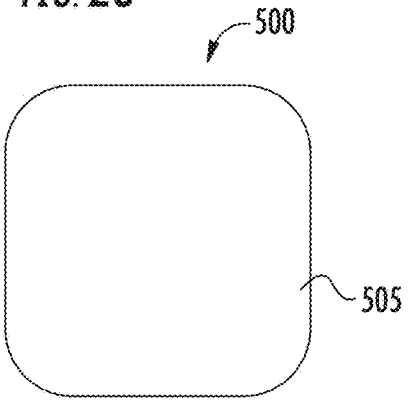
FIG. 29 is a bottom plan view of the third illustrated embodiment of the shim of FIG. 25.
Figure 30:
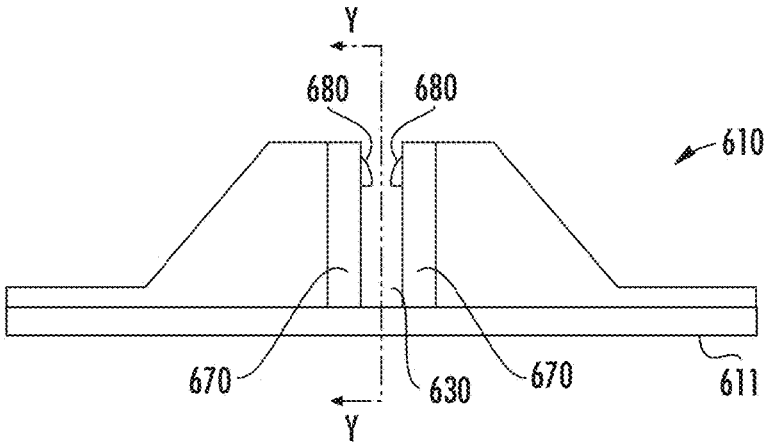
FIG. 30 is a side elevational view of a second illustrated embodiment of the bearing pad according to the present disclosure.
Figure 31:
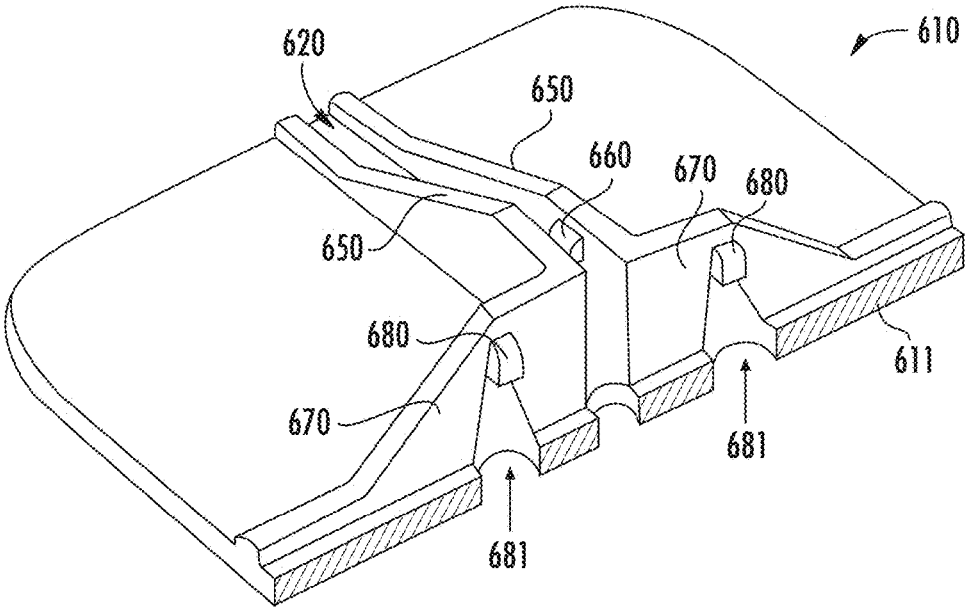
FIG. 31 is a cross-sectional perspective view from above of the illustrated embodiment of the bearing pad of FIG. 30, taken along section line Y-Y of FIG. 30.
Figure 32:
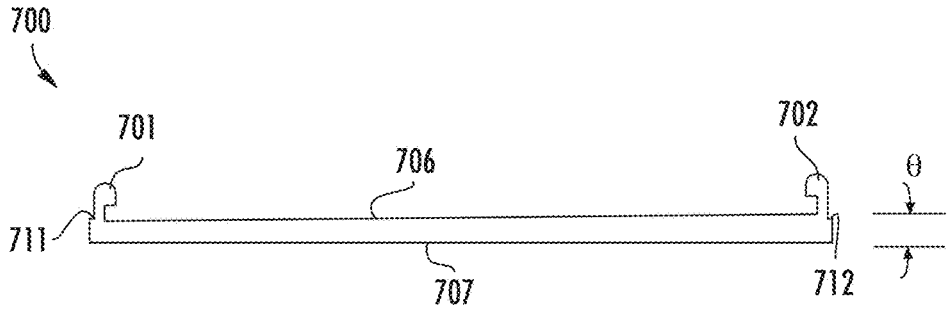
FIG. 32 is a side elevational view of a fourth illustrated embodiment of a shim for use under the bearing pad according to the present disclosure.
Figure 33:
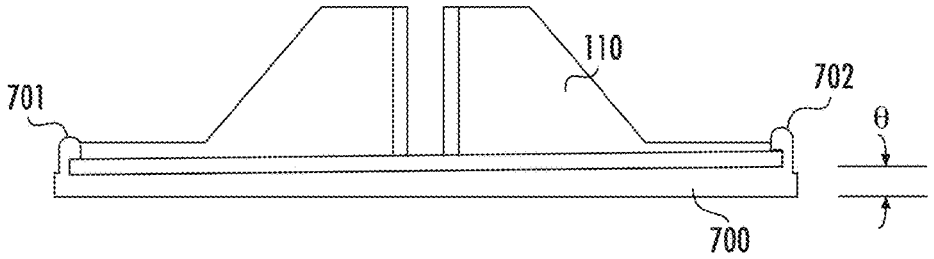
FIG. 33 is a side elevational view of the fourth illustrated embodiment shim of FIG. 32 and the bearing pad, with the bearing pad being received and retained in load bearing relation by the shim.
Figure 34:
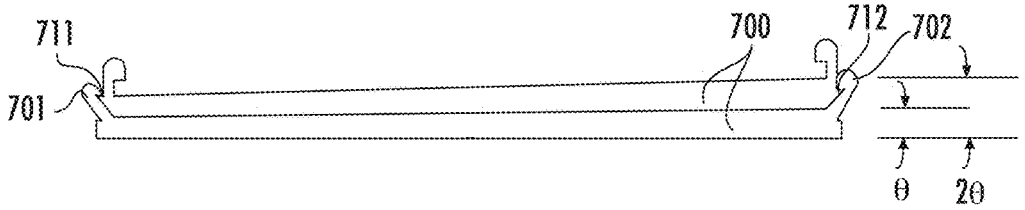
FIG. 34 is a side elevational view of two fourth illustrated embodiment shims of FIG. 32 retained together.

Referring to FIGS. 1 through 34 of the drawings, it will be noted that FIG. 1 is a general view of the present disclosure in use, FIGS. 2 and 3 show an illustrated embodiment of a bearing pad according to the present disclosure and a pathway module for use in constructing a pathway, FIGS. 4 through 8 show a first illustrated embodiment of a bearing pad according to the present disclosure, FIGS. 9 through 13 show a first illustrated embodiment of a shim according to the present disclosure, FIGS. 14 through 16 show the first illustrated embodiment of the shim according to the present disclosure and the bearing pad according to the present disclosure, FIGS. 17 through 21 show a second illustrated embodiment of a shim according to the present disclosure, FIGS. 22 through 24 show the second illustrated embodiment of a shim according to the present disclosure and the bearing pad according to the present disclosure, FIGS. 25 through 29 show the third illustrated embodiment of a shim according to the present disclosure, FIGS. 30 and 31 show a second illustrated embodiment of a bearing pad according to the present disclosure, and FIGS. 32 through 34 shows a fourth illustrated embodiment of a shim according to the present disclosure.

Reference will now be made to FIGS. 1 through 8, which show a first illustrated embodiment of a bearing pad according to the present disclosure, as indicated by the general reference numeral 110, for receiving and retaining substantially vertically oriented structural members 102 of a pathway module 104 for use in constructing a pathway and supporting the pathway module 104 on a ground surface 100, such as a gravel surface, which is a potentially uneven surface. The pathway modules 104 are for use in constructing a pathway for traffic 106, such as a pedestrian walkway, and more particularly a transit platform, adjacent a railroad track 108, as can be best seen in FIG. 1.

The pathway module 104, as illustrated, is preferably made from a suitable plastic material or combination of plastic materials, one or more composite materials, a metal material, or any other suitable materials or combination of materials. Typically, such pathway modules, which are also often referred to as panels, have a top deck with end walls and side walls depending from the top deck. Also, for added structural rigidity and strength, there is typically a plurality of general vertically oriented cross support members depending from the top deck. The substantially vertically oriented structural members 102 of a pathway module 104 may include, but are not limited to, the end walls, the side walls, and the general vertically oriented cross support members (i.e. ribs).

It should also be noted that the pathway module 104 might be any one or more of a panel, a tile, a platform, a platform portion, a deck, a deck portion, a plate, flooring, and the like.

The bearing pad 110 comprises a main body member 112 having a lower ground engaging surface 111 and a first upwardly open slot 120 and a second upwardly open slot 130, as will be discussed in greater detail subsequently. The first upwardly open slot 120 and the second upwardly open slot 130 are oriented substantially transversely one to the other and intersect at a vertically oriented common space 118. Further, the first upwardly open slot 120 is generally planar and is disposed generally transversely to the lower ground engaging surface 111 of the main body member 112. Similarly, the second upwardly open slot 130 is generally planar and is disposed generally transversely to the lower ground engaging surface 111 of the main body member 112.

Also, the first upwardly open slot 120 has a fully open top 123, a fully open first end 121 and a fully open second end 122 to thereby receive a substantially vertically oriented structural member 102 therein that is larger than the first upwardly open slot 120 such that a received substantially vertically oriented structural member 102 extends beyond the first upwardly open slot 120 at the fully open top 123, the fully open first end 121 and the fully open second end 122. Similarly, the second upwardly open slot 130 has a fully open top 133, a fully open first end 131 and a fully open second end 132 to thereby receive a substantially vertically oriented structural member 102 therein that is larger than the second upwardly open slot 130 such that a received substantially vertically oriented structural member 102 extends beyond the second upwardly open slot 130 at the fully open top 133, the fully open first end 131 and the fully open second end 132.

The main body member 112 of the bearing pad 110 further comprises a base member 140, a first left wall 150L, a first right wall 150R. The base member 140 as illustrated is substantially planar and also substantially flat. Also, as illustrated, the base member 140 is substantially square, although it can be of any suitable shape, such as circular, rectangular, triangular, oval, and so on. The main body member 112 may comprise one type of plastic material, and further may comprise a unitary piece of plastic material, for the sake of ease of manufacturing and low cost.

The first left wall 150L and the first right wall 150R each extend upwardly from the base member 140. In use, in a typical orientation of the bearing pad, the lower ground engaging surface 111 of the base member 140 comprises a bottom ground engaging surface 111 and would face downwardly to engage the ground, and accordingly, the first left wall 150L and the first right wall 150R would each extend substantially vertically upwardly.

As can be best seen in FIGS. 4, 5, 6 and 8, the first cross support member engaging portion 160 comprises a first left cross support member engaging surface 160L and a first right cross support member engaging surface 160R. The first left cross support member engaging surface 160L and the first right cross support member engaging surface 160R face each other to define a first gap 162 therebetween. The first gap 162 is disposed between the first left cross support member engaging surface 160L and the first right cross support member engaging surface 160R and is the first upwardly open slot 120. The first left cross support member engaging surface 160L is disposed on the first left wall 150L and the first right cross support member engaging surface 160R is disposed on the first right wall 150R.

The main body member 112 of the bearing pad 110 further comprises a second left wall 170L and a second right wall 170R each extending upwardly from the base member 140. In use, in a typical orientation of the bearing pad, the second left wall 170L and the second right wall 170R would each extend substantially vertically upwardly.

As can be best seen in FIGS. 2, 3, 4 and 6, the second cross support member engaging portion 180 comprises a second left cross support member engaging surface 180L and a second right cross support member engaging surface 180R. The second left cross support member engaging surface 180L and the second right cross support member engaging surface 180R face each other to define a second gap 172 therebetween. The second gap 172 is between the left cross support member engaging surface and is the right cross support member engaging surface is the second upwardly open slot 130. The second left cross support member engaging surface 180L is disposed on the second left wall 170L and the second right cross support member engaging surface 180R is disposed on the second right wall 170R.

As can be readily seen in the Figures, the first upwardly open slot 120 is defined by the first cross support member engaging portion 160 of the main body member 112 and the second upwardly open slot 130 is defined by the second cross support member engaging portion 180 of the main body member 112.

Each of the first left wall 150L, the first right wall 150R, the second left wall 170L and the second right wall 170R comprise two longitudinally aligned wall portions. More specifically, the first left wall 150L comprises two longitudinally aligned wall portions 150LA, 150LB. Similarly, the first right wall 150R comprises two longitudinally aligned wall portions 150RA, 150RB. Also, similarly, the second left wall 170L comprises two longitudinally aligned wall portions 170LA, 170LB. Once again similarly, the second right wall 170R comprises two longitudinally aligned wall portions 170RA, 170RB.

Moreover, each of the longitudinally aligned wall portions 150LA, 150LB, 150RA, 150RB, 170LA, 170LB, 170RA, 170RB comprises a horizontal-top-edge portion 190 disposed adjacent the vertically oriented common space 118 and a sloped-top-edge portion 192 extending outwardly from the horizontal top edge portion 190.

In order to maximize the effectiveness of the wall portions 150LA, 150LB, 150RA, 150RB, 170LA, 170LB, 170RA, 170RB while minimizing the amount of plastic used, of the longitudinally aligned wall portions further comprises a rail portion 194 extending outwardly from the sloped-top-edge portion 192.

Further, each of the first left wall 150L and a first right wall 150R has a width "WW", and the width "WW" of the first left wall 150L and the width of the first right wall 150R are substantially the same one as the other. Also, each of the first gap 162 and the second gap 172 has a width "WG". As can be readily seen, the width of the first gap 162 is slightly greater than the width of the first left wall 150L and the width of the first right wall 150R. Similarly, the width of the second gap 172 is slightly greater than the width of the second left wall 170L and the width of the second right wall 170R.

It should also be noted that the size and draft angle of the first gap 162 and the second gap 172 can be selected to properly accommodate the thickness of the substantially vertically oriented structural member 102 that the first gap 162 and the second gap 172 will be receiving and retaining.

Figure 4:
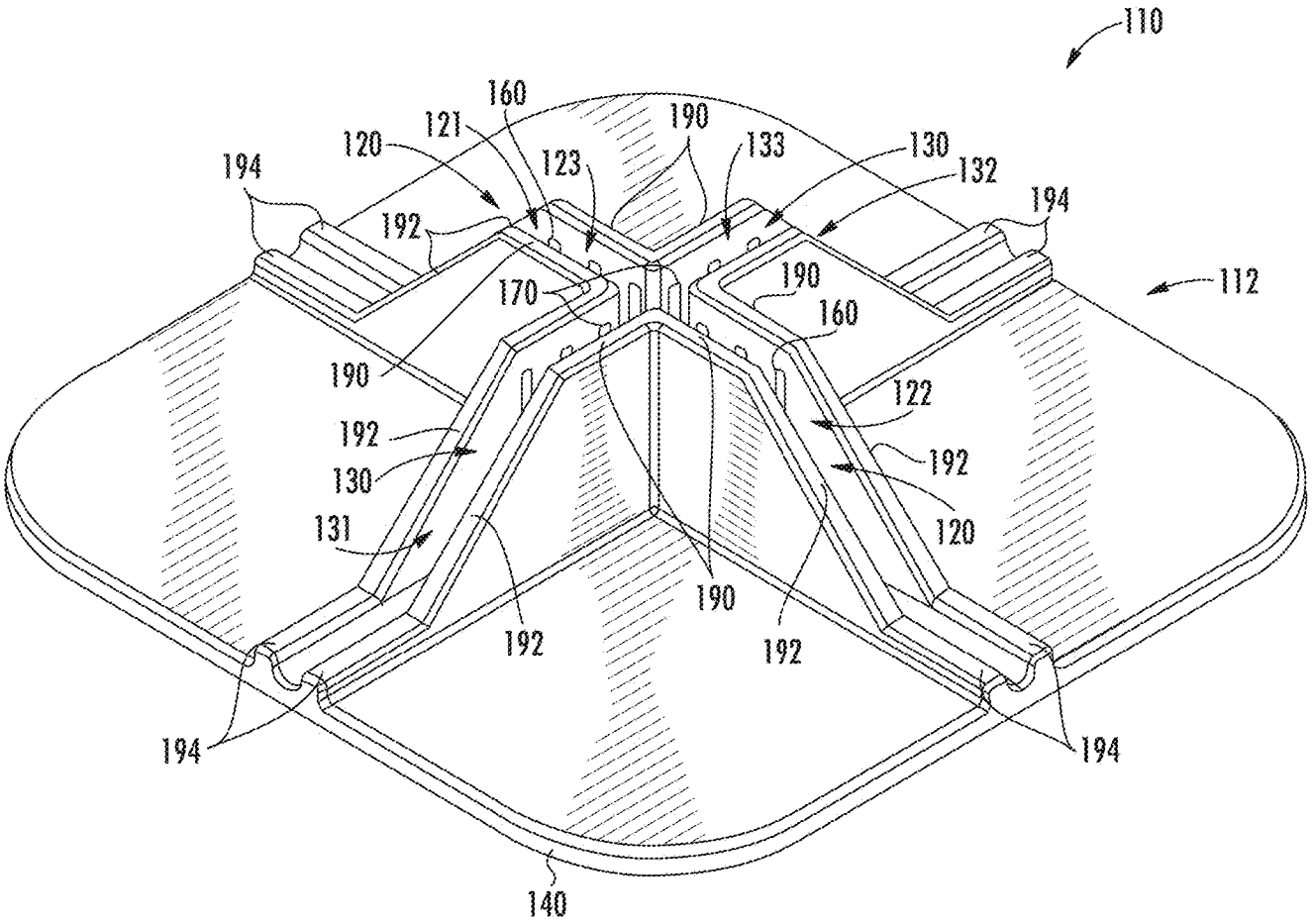
FIG. 4 is a perspective view from above of a first illustrated embodiment of the bearing pad according to the present disclosure.
Figures 5, 6, 7, 8:
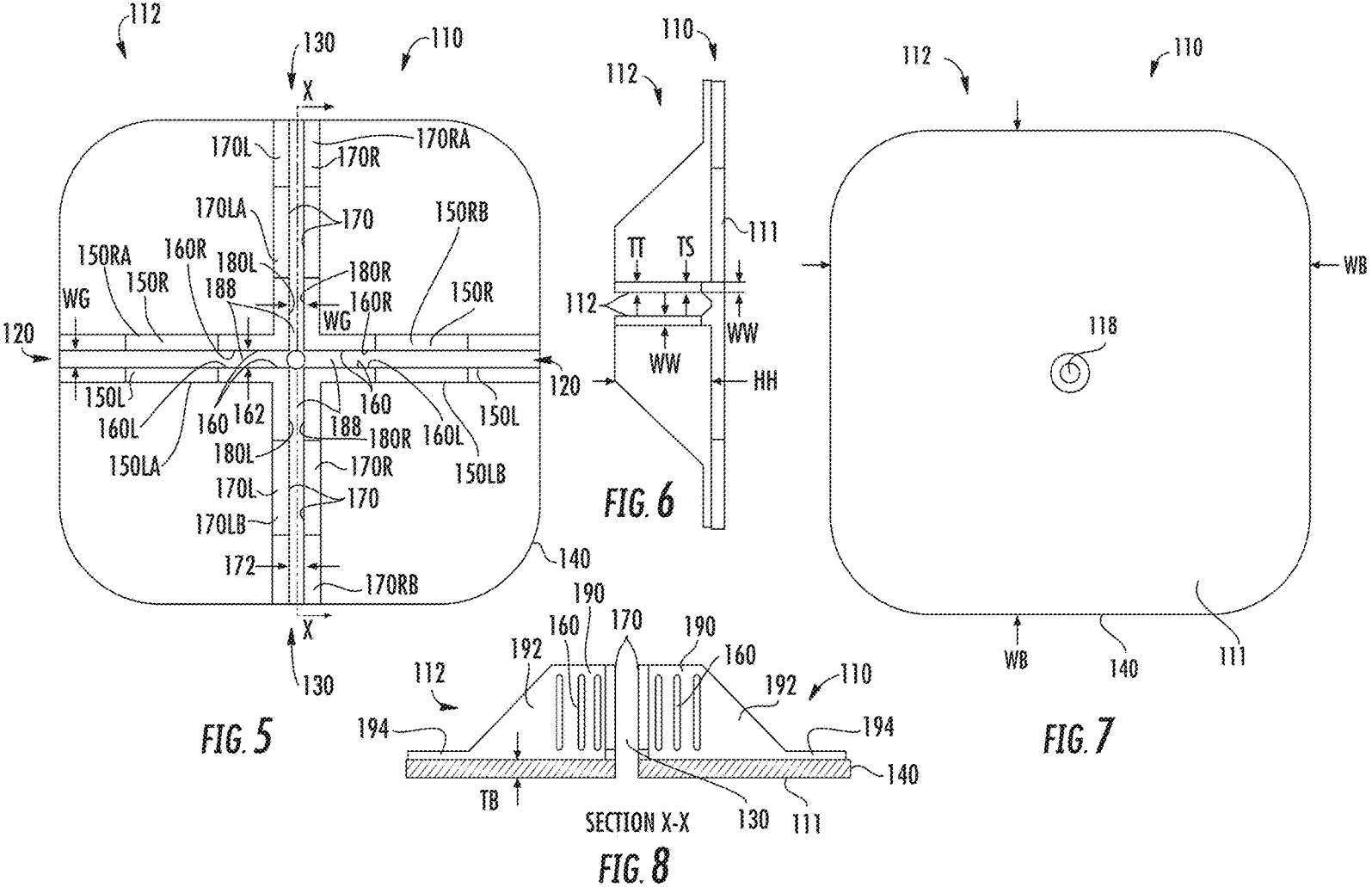
FIG. 5 is a top plan view of the illustrated embodiment of the bearing pad of FIG. 4.
FIG. 6 is a side elevational view of the illustrated embodiment of the bearing pad of FIG. 4.
FIG. 7 is a bottom plan view of the illustrated embodiment of the bearing pad of FIG. 4.
FIG. 8 is a cross-sectional side elevational view of the illustrated embodiment of the bearing pad of FIG. 2, taken along section line X-X of FIG. 5.
Figure 9:
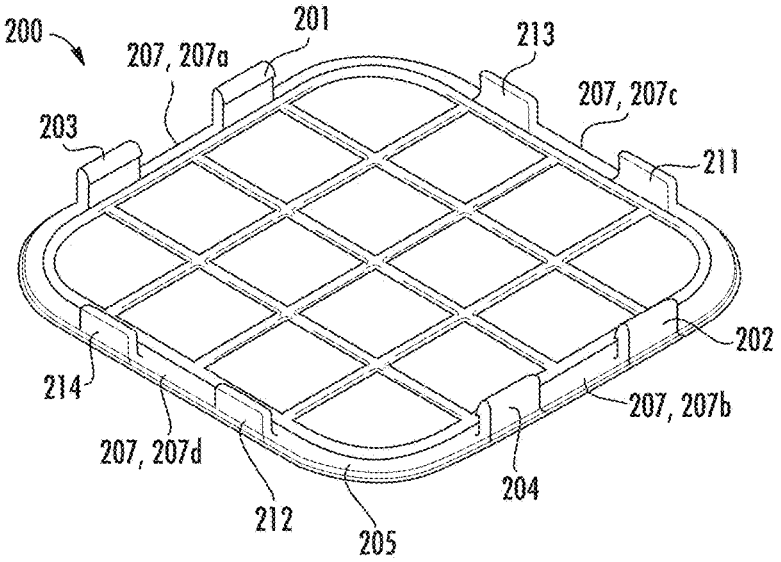
FIG. 9 is a perspective view from above of the first illustrated embodiment of the shim for use under the bearing pad according to the present disclosure.
Figure 10:
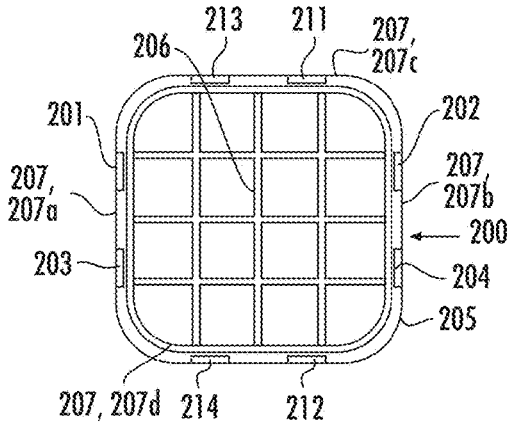
FIG. 10 is a top plan view of the first illustrated embodiment of the shim of FIG. 9.
Figure 11:
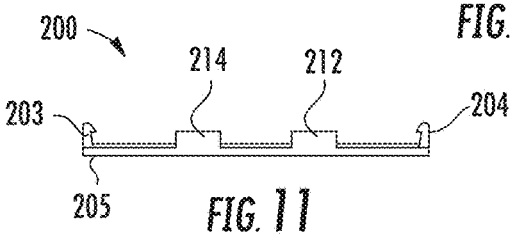
FIG. 11 is a front elevational view of the first illustrated embodiment of the shim of FIG. 9.
Figure 12:
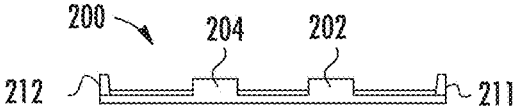
FIG. 12 is a side elevational view of the first illustrated embodiment of the shim of FIG. 9.
Figure 13:
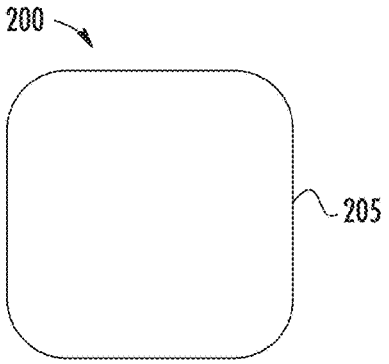
FIG. 13 is a bottom plan view of the first illustrated embodiment of the shim of FIG. 9.

Also is can readily be seen in FIG. 4, the base member 140 has a width "WB" and each horizontal-top-edge portion 180 has a height "HH", and the ratio of the width "WB" of the base member 140 to the height "HH" of each horizontal-top-edge portion 190 is between 4:1 and 5:1. Further, the base member 140 has a thickness "TB", each horizontal-top-edge portion 190 has a thickness "TT", and each sloped-top-edge portion 192 has a thickness "TS", and the ratio of the thickness "TB" of the base member 140 to the thickness "TT" of each horizontal-top-edge portion 190 and the thickness "TS" of each sloped-top-edge portion 192 is about 5:4. The width "WB" and the thickness "TB" of the base member 140, and the height "HH" and thickness "TB" of the horizontal-top-edge portion 190, and the thickness "TS" of the sloped-top-edge portion 192 can be selected to properly accommodate the various parameters of the substantially vertically oriented structural member 102 and the dynamic loads that will be placed on it.

The first and second cross support member engaging portions 160 and 180 further comprise a generally upwardly facing weight bearing stop surface 188 that bears the downward vertical force transmitted by a substantially vertically oriented structural member 102 that is received and retained in either the first upwardly open slot 120 or the second upwardly open slot 130. The generally upwardly facing weight bearing stop surface 188 is substantially cross-shaped and is disposed partially between the first left wall 150L and the first right wall 150R and disposed partially between the second left wall 170L and the second right wall 170R.

In use, a plurality of bearing pads 110 are individually introduced to the pathway module 104, as indicated by arrow "A" in FIG. 2, and as seen in place in FIG. 3, such that one of the substantially vertically oriented structural members 102 of the pathway module 104 is slidably received and retained in the first upwardly open slot 120 is securely retained in place in frictional relation by the cross support member engaging portion of the main body member 112. Further, another substantially vertically oriented structural member 102 of the pathway module 104 that is slidably received and retained in the second upwardly open slot 130 is securely retained in place in frictional relation by the second cross support member engaging portion 180 of the main body member 112. In this manner, the pathway module 104 and the bearing pad 110 are securely retained together such that when the pathway module 104 is being installed in place to construct a pathway for traffic 106, such as a pedestrian walkway. Further, the bearing pad 110 reinforces the substantially vertically oriented structural member 102.

It should be noted that when the bearing pad 110 is received by two substantially vertically oriented structural members 102 that are end walls or side walls of the pathway module 104, the bearing pad 110 acts as a connector to help retain the two adjacent pathway modules 104 securely together.

In another aspect of the present disclosure, that can be best seen in FIGS. 9 through 13, there is disclosed a first illustrated embodiment of a shim 200 that is positionable under the bearing pad 110. The first illustrated embodiment of the shim 200 comprises a base portion 205 having a perimeter edge 207 and a central portion 206. The perimeter edge 207 has a first perimeter edge portion 207*a*, a second perimeter edge portion 207*b*, a third perimeter edge portion 207*c*, and a fourth perimeter edge portion 207*d*. A first hook member 201 and a second hook member 202 each extend upwardly from the base portion 205 at the perimeter edge 207 of the base portion 205. The first hook member 201 is disposed at the first perimeter edge portion 207*a* and the second hook member 202 is disposed at the second perimeter edge portion 207*b*, and accordingly are disposed in opposed relation on the base portion 205 with the central portion 206 disposed therebetween. Also, a third hook member 203 is disposed at the first perimeter edge portion 207*a* and a fourth hook member 204 is disposed at the second perimeter edge portion 207*b*, and accordingly are disposed in opposed relation on the base portion 205 with the central portion 206 disposed therebetween. The hook members 201, 202, 203, 204 each engage a small portion of a top surface of the base member 140 of the bearing pad 110 to securely retain the shim 200 to the bearing pad 110.

Further, a first guide member 211 and a second guide member 212 each extend upwardly from the base portion 205 at the perimeter edge 207 of the base portion 205. The first guide member 211 is disposed at the third perimeter edge portion 207*c* and the second guide member 212 is disposed at the fourth perimeter edge portion 207*d*, and are accordingly disposed in opposed relation on the base portion 205 with the central portion 206 disposed therebetween. Also a third guide member 213 is disposed at the third perimeter edge portion 207*c* and a fourth guide member 214 is disposed at the fourth perimeter edge portion 207*d*, and accordingly are disposed in opposed relation on the base portion 205 with the central portion 206 disposed therebetween. Together, the hook members 201, 202, 203, 204 and the guide members 211, 212, 213, 214 preclude lateral movement of the shim 200 and the bearing pad 110 with respect to each other.

In another aspect of the present disclosure, that can be best seen in FIGS. 14 through 16, there is disclosed an apparatus 300 for receiving and retaining the substantially vertically oriented structural members 102 of a pathway module 104 for use in constructing a pathway and supporting the pathway module 104 on a ground surface 100. The apparatus comprises the bearing pad 110 having the lower ground engaging surface 111, the first upwardly open slot 120, the second upwardly open slot 130, and the shim 200 securable to the bearing pad 110 in underlying relation thereto. There is also means 310 for selectively securing the bearing pad 110 and the shim 200 one to the other such that the bearing pad 110 and the shim 200 remain secured together during use. The means 310 for selectively securing the bearing pad 110 and the shim 200 one to the other comprises the first hook member 201, the second hook member 202, the third hook member 203 and the fourth hook member 204, which each extend upwardly from the base portion 205 of the shim 200.

In use, a substantially vertically oriented structural member 102 of the pathway module 104 that is slidably received and retained in the first upwardly open slot 120 is securely retained in place by the bearing pad 110, and a substantially vertically oriented structural member 102 of the pathway module 104 that is received and retained in the second upwardly open slot 130 is securely retained in place by the bearing pad 110. The bearing pad 110 is slidably received and retained in load bearing relation by the shim 200.

Reference will now be made to FIGS. 17 through 24, which show a second illustrated embodiment of a shim 400 according to the present disclosure. The second illustrated embodiment of the shim 400 is similar to the first illustrated embodiment of the shim 200 except that it stackable and/or nestable with other similar shims 400; however, it requires separate fasteners to connect together similar shims 400.

More specifically, the second illustrated embodiment of the shim 400 comprises a base portion 405 having a perimeter edge 407 and a central portion 406. The perimeter edge 407 has a first perimeter edge portion 407*a*, a second perimeter edge portion 407*b*, a third perimeter edge portion 407*c*, and a fourth perimeter edge portion 407*d*. A first fastener-receiving aperture 401 is disposed in the base portion 405 adjacent the first perimeter edge portion 407*a*. Similarly, a second fastener-receiving aperture 402 is disposed in the base portion 405 adjacent the fourth perimeter edge portion 407*d*. Also, a third fastener-receiving aperture 403 is disposed in the base portion 405 adjacent the third perimeter edge portion 407*c*. Threaded fasteners 410 are used to secure together two shims 400. In the above described manner, the second illustrated embodiment shim 400 can be stacked with other like shims 400 to produce a selected height stack of shims.

Reference will now be made to FIGS. 25 through 29, which show a third illustrated embodiment of a shim 500 according to the present disclosure. The third illustrated embodiment of the shim 500 is similar to the first illustrated embodiment of the shim 200 in not requiring separate fasteners to connect together the bearing pad 110 and the shim 200, 500. Further, the third illustrated embodiment of the shim 500 is similar to the second illustrated embodiment shim 400 in that they are each stackable and/or nestable with other similar shims 400, 500.

More specifically, the third illustrated embodiment of the shim 500 comprises a base portion 505 having a perimeter edge 507 and a central portion 506. The perimeter edge 507 has a first perimeter edge portion 507*a*, a second perimeter edge portion 507*b*, a third perimeter edge portion 507*c*, and a fourth perimeter edge portion 507*d*. A first hook member 501 and a second hook member 502 each extend upwardly from the base portion 505 at the perimeter edge 507 of the base portion 505. The first hook member 501 is disposed at the first perimeter edge portion 507*a* and the second hook member 502 is disposed at the second perimeter edge portion 507*b*, and accordingly are disposed in opposed relation on the base portion 505 with the central portion 506 disposed therebetween. Also, a third hook member 503 is disposed at the first perimeter edge portion 507*a* and a fourth hook member 504 is disposed at the second perimeter edge portion 507*b*, and accordingly are disposed in opposed relation on the base portion 505 with the central portion 506 disposed therebetween. The hook members 501, 502, 503, 504 each engage a small portion of the top surface of the base member 140 of the bearing pad 110 to securely retain the shim 500 on the bearing pad 110.

Further, a first indent 511 is disposed at the third perimeter edge portion 507*c* and a second indent 512 is disposed at the fourth perimeter edge portion 507*d*, and accordingly are disposed in opposed relation on the base portion 505 with the central portion 506 disposed therebetween. Also a third indent 513 is disposed at the third perimeter edge portion 507*c* and a fourth indent 514 is disposed at the fourth perimeter edge portion 507*d*, and accordingly are disposed in opposed relation on the base portion 505 with the central portion 506 disposed therebetween. The hook members 501, 502, 503, 504 are positioned such that they engage the indents 511, 512, 513, 514, respectively, when two shims 500 are engaged with one another such that the hook members 501, 502, 503, 504 are aligned with the indents 511, 512, 513, 514. The hook members 501, 502, 503, 504 each engage a small portion of the top surface 508 of the base member 505 adjacent the indents 511, 512, 513, 514, to securely retain two shims 500 to each other. In the above described manner, the third illustrated embodiment of the shim 500 can be stacked with other like shims 500 to produce a selected height stack of shims without the use of separate fasteners.

Reference will be now made to FIGS. 30 through 31, which show another embodiment of a bearing pad 610 according to the present disclosure. The bearing pad 610 has a first cross support member engaging surface 660 that extends from the first right wall 650R and from the first left wall 650L into the first slot 620, and a second cross support member engaging surface 680 that extends from the second right wall 670R and from the second left wall 670L into the second slot 630. For example, the first cross support member engaging surface 660 and the second cross support member engaging surface 680 may be curved or planar. When a substantially vertically oriented structural member 102 is received in the first slot 620 and the second slot 630, the substantially vertically oriented structural member 102 contacts the first cross support member engaging surface 660 and the second cross support member engaging surface 680. This contact can cause the first right wall 650R, the first left wall 650L, the second right wall 670R, and the second left wall 670L to flex, and provide a pinching effect to retain the substantially vertically oriented structural member 102 in the first slot 620 and the second slot 630.

The first cross support member engaging surface 660 and second cross support member engaging surface 680 can be integrally molded features. For example, pins may be inserted into the lower ground engaging surface 611 of the bearing pad 610 to deform the walls 650R, 650L, 670R, and 670L, which forms the first cross support member engaging surfaces 660 and second cross support member engaging surfaces 680 thereon. When the bearing pad 610 is removed from the mold, holes 681 in the lower ground engaging surface 611 are present from where the pins were inserted. The holes 681 can contribute to the ability of walls 650R, 650L, 670R, and 670L to flex during use. The ability of walls 650R, 650L, 670R, and 670L to flex can avoid cracking and ultimate failure of the bearing pad 610 during use.

Reference will be now made to FIGS. 32 through 34, which show a fourth illustrated embodiment of a shim 700 according to the present disclosure. The shim 700, shown in FIG. 32, includes a first hook 701, a second hook 702, a top surface 706, a bottom surface 707, a first hook engaging surface 711, and a second hook engaging surface 712. The top surface 706 and the bottom surface 707 may be angled relative to one another, an angle θ. For example, the angle θ may be about 1°. The angle θ may be any suitable angle, and is not limited by the examples provided herein.

The first hook 701 and the second hook 702 extend from the top surface 706 at opposite ends of the shim 700, and engage a small portion of a top surface of the base member 140 of the bearing pad 110 to securely retain the shim 700 to the bearing pad 110, as shown in FIG. 33. By securing the shim 700 to the bearing pad 110, the slope of the pathway module 104 may be modified by the angle θ. Changing the slope of the pathway module 104 may be desirable to facilitate drainage, for example water runoff. Alternatively, the angle θ may level the pathway module 104 on a sloped ground surface.

The first hook engaging surface 711 and the second hook engaging surface 712 may be configured to receive the first hook 701 and the second hook 702 of a second shim 700, to securely retain the two shims 700 together, as shown in FIG. 34. By securing multiple shims 700 to a bearing pad 110, the slope provided to the pathway module 104 may be compounded. For example, two shims 700 may provide a slope of angle 20. For example, if each shim provides an angle θ of 1°, the combination of two shims 700 will provide a total of 2°. Any number of additional shims 700 may be connected to further contribute to the slope modification. Alternatively, each shim 700 may provide different angles θ, for further customization of the slope of the pathway module 104.

Other variations of the above principles will be apparent to those who are knowledgeable in the field of the disclosure, and such variations are considered to be within the scope of the present disclosure. Further, other modifications and alterations may be used in the design and manufacture of the bearing pad and shim, of the present disclosure, without departing from the spirit and scope of the accompanying claims.

Other variations are within the spirit of the present disclosure. Thus, while the disclosure is susceptible to various modifications and alternative constructions, a certain illustrated embodiment thereof is shown in the drawings and has been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising", "having", "including", and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as", "for example") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Illustrated embodiments of this disclosure are described herein. Variations of those illustrated embodiments may become apparent to those of ordinary skill in the art upon reading the foregoing description. The inventor expects skilled artisans to employ such variations as appropriate, and the inventor intends for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

Although the present disclosure has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A system for constructing a pathway comprising:

a pathway module including:

a top deck configured to cover a ground surface; and a rib extending away from the top deck; and a bearing pad configured to slidably receive the rib, including a main body member having a lower ground engaging surface on a first face and a first slot disposed on a second face, opposite the first face, the first slot being defined by a first cross support member engaging portion of the main body member, wherein the rib is configured to be received and retained in the first slot by the first cross support member engaging portion of the main body member;

a shim securable to the bearing pad in underlying relation thereto, the shim including a central portion and a base portion that surrounds the central portion, the base portion having a perimeter edge, wherein the shim includes:

an aperture disposed in the base portion adjacent to a portion of the perimeter edge; and a fastener extending through the aperture;

wherein the fastener is configured to engage the base member of the bearing pad to securely retain the shim thereto.

2. The system of claim 1, wherein the first cross support member engaging portion of the bearing pad includes:

a left cross support member engaging surface; and a right cross support member engaging surface;

wherein the left cross support member engaging surface and the right cross support member engaging surface face each other to define a first gap therebetween.

3. The system of claim 2, wherein the main body member of the bearing pad includes:

a base member;

a first left wall and a first right wall each extending upwardly from the base member;

wherein the left cross support member engaging surface is disposed on the first left wall and the right cross support member engaging surface is disposed on the first right wall.

4. The system of claim 3, wherein the first cross support member engaging portion includes an upwardly facing weight bearing stop surface that bears the downward vertical force transmitted by the rib that is configured to be received and retained in the first slot.

5. The system of claim 3, wherein the left cross support member engaging surface and the right cross support member engaging surface protrude from the first left wall and the first right wall into the first gap; and wherein the bearing pad includes holes through the lower ground engaging surface and partially through the first left wall and the first right wall.

6. The system of claim 1, wherein the bearing pad includes a second slot defined by a second cross support member engaging portion of the main body member, the second slot is disposed on the second face; and wherein the pathway module includes a second rib configured to be received and retained in the second slot by the second cross support member engaging portion of the main body member.

7. The system of claim 6, wherein the first slot and the second slot are oriented perpendicular relative to one another and intersect at a vertically oriented common space;

wherein the left cross support member engaging surface is a first left cross support member engaging surface and the right cross support member engaging surface is a first right cross support member engaging surface; and wherein the second cross support member engaging portion includes a second left cross support member engaging surface and a second right cross support member engaging surface, and wherein the second left cross support member engaging surface and the second right cross support member engaging surface face each other to define a second gap therebetween.

8. The system of claim 7, wherein the main body member further includes:

a second left wall and a second right wall each extending upwardly from the base member;

wherein the second left cross support member engaging surface is disposed on the second left wall and the second right cross support member engaging surface is disposed on the second right wall.

9. The system of claim 8, wherein the upwardly facing weight bearing stop surface is disposed partially between the first left wall and the first right wall and disposed partially between the second left wall and the second right wall, and is substantially cross-shaped.

10. The system of claim 8, wherein each of the first left wall, the first right wall, the second left wall, and the second right wall of the bearing pad include two longitudinally aligned wall portions includes:

a horizontal-top-edge portion disposed adjacent the vertically oriented common space;

a sloped-top-edge portion extending outwardly from the horizontal-top-edge portion; and a rail portion extending outwardly from the sloped-top-edge portion.

11. The system of claim 1, wherein the shim includes:

a first hook member extending upwardly from the base portion at a first perimeter edge portion of the perimeter edge; and a second hook member extending upwardly from the base portion at a second perimeter edge portion of the perimeter edge;

wherein the first hook member and the second hook member are disposed in opposed relation on the base portion with the central portion disposed therebetween; and wherein the first hook member and the second hook member being configured to engage the base member of the bearing pad to securely retain the shim thereto.

12. The system of claim 11, wherein the shim includes:

a first guide member extending upwardly from the base portion at a third perimeter edge portion of the perimeter edge; and a second guide member extending upwardly from the base portion at a fourth perimeter edge portion of the perimeter edge;

wherein the first guide member and the second guide member are disposed in opposed relation on the base portion with the central portion disposed therebetween; and wherein the first hook member, the second hook member, the first guide member, and the second guide member preclude lateral movement of the shim and the bearing pad relative to each other.

13. The system of claim 12, wherein the shim includes:

a third hook member extending upwardly from the base portion at a first perimeter edge portion of the perimeter edge, adjacent to the first hook member; and a fourth hook member extending upwardly from the base portion at a second perimeter edge portion of the perimeter edge, adjacent to the second hook member;

a third guide member extending upwardly from the base portion at a third perimeter edge portion of the perimeter edge, adjacent to the first guide member; and a fourth guide member extending upwardly from the base portion at a fourth perimeter edge portion of the perimeter edge, adjacent to the second guide member;

wherein the third hook member and the fourth hook member are disposed in opposed relation on the base portion with the central portion disposed therebetween, the third hook member and the fourth hook member being configured to engage the base member of the bearing pad to securely retain the shim thereto;

wherein the third guide member and the fourth guide member are disposed in opposed relation on the base portion with the central portion disposed therebetween; and wherein the first hook member, the second hook member, the third hook member, the fourth hook member, the first guide member, the second guide member, the third guide member, and the fourth guide member preclude lateral movement of the shim and the bearing pad relative to each other.

14. The system of claim 11, wherein the shim includes:

a first indent disposed in the base portion at a third perimeter edge portion of the perimeter edge; and a second indent disposed in the base portion at a fourth perimeter edge portion of the perimeter edge.

15. The system of claim 14, further comprising:

a second shim including:

a central portion and a base portion that surrounds the central portion, the base portion having a perimeter edge;

a first hook member extending upwardly from the base portion at a first perimeter edge portion of the perimeter edge; and a second hook member extending upwardly from the base portion at a second perimeter edge portion of the perimeter edge;

wherein the first hook member and the second hook member are disposed in opposed relation on the base portion with the central portion disposed therebetween;

wherein the first indent is configured to receive the first hook member of an the second shim and the second indent is configured to receive the second hook member of the second shim to securely retain the second shim to the shim.

16. The system of claim 1, further comprising:

a second shim including:

a central portion and a base portion that surrounds the central portion, the base portion having a perimeter edge; and an aperture disposed in the base portion adjacent to a portion of the perimeter edge;

wherein the threaded fastener extends through the aperture of each of the shim and the second shim, and is configured to engage the base member of the bearing pad to securely retain the shim and the second shim thereto.

17. The system if claim 11, wherein the shim includes:

a top surface; and a bottom surface angled relative to the top surface.

18. A system for constructing a pathway comprising:

a pathway module including:

a top deck configured to cover a ground surface; and a rib extending from the top deck towards the ground surface, including:

a first rib extending across the pathway module; and a second rib extending across the pathway module, the second rib intersecting the first rib at an intersection;

a bearing pad configured to slidably receive the rib of the pathway module positioned at the intersection, the bearing pad including:

a main body member having a lower ground engaging surface, a first slot defined by a first cross support member engaging portion of the main body member, and a second slot defined by a second cross support member engaging portion of the main body member;

a shim securable to the bearing pad in underlying relation thereto, the shim including a central portion and a base portion that surrounds the central portion, the base portion having a perimeter edge, wherein the shim includes:

an aperture disposed in the base portion adjacent to a portion of the perimeter edge; and a fastener extending through the aperture;

wherein the fastener is configured to engage the base member of the bearing pad to securely retain the shim thereto; and wherein the first rib is configured to be received and retained in the first slot by the first cross support member engaging portion of the main body member, the second rib is configured to be received and retained in the second slot by the second cross support member engaging portion of the main body member, and the intersection of the first rib and the second rib being configured to be received in the vertically oriented common space.

* * * * *